US007845777B2

(12) United States Patent
Nishida

(10) Patent No.: US 7,845,777 B2
(45) Date of Patent: Dec. 7, 2010

(54) INKJET PRINTER

(75) Inventor: Katsunori Nishida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 775 days.

(21) Appl. No.: 11/891,603

(22) Filed: Aug. 10, 2007

(65) Prior Publication Data

US 2008/0036816 A1 Feb. 14, 2008

(30) Foreign Application Priority Data

Aug. 11, 2006 (JP) ..... 2006-219282

(51) Int. Cl.
*B41J 2/175* (2006.01)

(52) U.S. Cl. ..... 347/85; 347/20; 347/30

(58) Field of Classification Search ..... 347/20, 347/30, 85–87
See application file for complete search history.

(56) References Cited

U.S. PATENT DOCUMENTS

| | | | | |
|---|---|---|---|---|
| 5,963,237 | A | 10/1999 | Ikkatai et al. | |
| 6,022,102 | A | 2/2000 | Ikkatai et al. | |
| 6,276,784 | B1 | 8/2001 | Ikkatai et al. | |
| 6,280,022 | B1 * | 8/2001 | Reinten | 347/70 |
| 7,150,519 | B2 | 12/2006 | Kono et al. | |
| 2005/0088494 | A1 | 4/2005 | Shimizu et al. | |
| 2005/0253488 | A1 | 11/2005 | Ito | |
| 2006/0012629 | A1 * | 1/2006 | Yoshida | 347/33 |
| 2006/0028519 | A1 | 2/2006 | Nakamura et al. | |
| 2008/0122884 | A1 * | 5/2008 | Ide et al. | 347/9 |
| 2009/0141071 | A1 * | 6/2009 | Kubo et al. | 347/29 |

FOREIGN PATENT DOCUMENTS

| | | |
|---|---|---|
| JP | 10-6521 | 1/1998 |
| JP | 11254701 | 9/1999 |
| JP | 2002-248779 | 9/2002 |
| JP | 2004-181846 | 7/2004 |
| JP | 2005-125635 | 5/2005 |
| JP | 2005-262540 | 9/2005 |
| JP | 2005-322850 | 11/2005 |

* cited by examiner

*Primary Examiner*—Ellen Kim
(74) *Attorney, Agent, or Firm*—Frommer Lawrence & Haug LLP

(57) ABSTRACT

Two yellow buffer tanks communicate with each other through a communication portion so that yellow ink in the yellow ink cartridge is supplied to two nozzle arrays for yellow ink independently provided apart from each other. In the ink outlet provided in each of the yellow buffer tanks, a check valve is provided that allows supply of yellow ink to the corresponding nozzle array and inhibits an ink flow in the opposite direction.

4 Claims, 5 Drawing Sheets

34 : SWITCHING VALVE
35 : PUMP

INKJET PRINTER

CROSS-REFERENCE TO RELATED APPLICATIONS

This Nonprovisional application claims priority under 35 U.S.C. §119(a) on Patent Application No. 2006-219282 filed in Japan on Aug. 11, 2006, the entire contents of which are hereby incorporated by reference.

BACKGROUND

The present invention relates to an inkjet printer.

An example of inkjet printers that jet a plurality of inks to a recording medium to perform recording is disclosed in Patent Document 1 (Japanese Patent Application Laid-Open No. 2005-125635). In this inkjet printer, inks are stored in their respective ink reservoirs from ink cartridges as ink supply sources through ink supply tubes, and are supplied from a plurality of ink outlets provided in the ink reservoirs to a plurality of nozzles of the recording head. Since there are cases where nozzles of the recording head are clogged because of mixture of air in the ink or thickening of the ink remaining in the recording head and the clogging affects the jetting quality, a maintenance operation such as a suction restoration operation of sucking ink from the nozzles is performed to restore ink jetting by eliminating the clogging of the nozzles.

In recent years, the number of nozzles of recording heads has been increased in order to increase the printing speed and the resolution. In the second embodiment of Patent Document 1, two recording heads are juxtaposed, and as shown in FIG. 12, the ink reservoirs supplying ink to the recording heads each have two ink outlets. In such a structure, there are cases where for a specific ink, two ink outlets of the same ink are necessarily disposed apart from each other because of the layout, and ink is continuous in the two ink outlets (in Patent Document 1, the ink outlets 41*c* for yellow ink are disposed apart from each other). In Patent Document 2 (Japanese Patent Application Laid-Open No. H11-254701) and Patent Document 3 (Japanese Patent Application Laid-Open No. 2004-181846), a plurality of recording heads are provided to perform printing on both ways of the reciprocating scanning of the recording heads, and in order that no difference in color is caused at the time of the reciprocating scanning of the recording heads, the two recording heads supplying ink from the same ink tank are disposed apart from each other in a mirror-image relation and ink is jetted from each nozzle.

SUMMARY

The nozzle arrangement of inkjet printers having this structure is such that ink supplied from the same ink tank is jetted from the nozzles disposed apart from each other. Consequently, when the suction restoration operation is performed on the nozzles disposed apart from each other, since ink is stored in the same ink tank, ink is continuous in the communication portion, that is, the ink reservoir (Patent Document 1), the air buffer (Patent Document 2) and the ink tank (Patent Document 3), and when suction is performed from the nozzles of one recording head, there is a possibility that not only ink from the ink tank flows in but also outside air is sucked from the nozzles of the other recording head because a negative pressure is caused in the nozzles of the other recording head through the communication portion and this makes jetting from the nozzles of the other recording head impossible. This makes it necessary to simultaneously perform suction from the nozzles of the two recording heads, so that a large amount of ink is wasted.

For this reason, in Patent Document 2, the two head tubes connected from the air buffer to the two recording heads are each provided with a circulation valve, and when the suction restoration is performed on the nozzles of a specific recording head, one of the ink flow paths connected to the recording head is closed so that no ink flows therethrough, and the restoration operation is performed on only the nozzles of the other recording head. In the circulation valves, a lever pushes a pressing member by a pushing force caused by a rotation of a cam to press the tube sandwiched between a reception member and the pressing member, thereby stopping the ink flow.

In Patent Document 3, the tubes connected from the same ink tank to the two recording heads are each provided with a valve mechanism, suction is simultaneously performed from the recording heads, and one of the valve mechanisms is closed. Consequently, the other valve mechanism is opened when a negative pressure is caused in the nozzles of the other recording head, so that an ink flow occurs only in the nozzles of one recording head and no ink flows in the nozzles of the other recording head. In the valve mechanisms, a pressurizing cam fixed to a driving shaft is rotated and a pressurizing lever presses and releases the tubes, thereby stopping and releasing the ink flow.

However, in the structure in which one of the tubes connected to the recording heads is pressed so that no ink flows therethrough and the suction restoration is performed only on the nozzles of the other recording head as in Patent Documents 2 and 3, the flow path structure is complicated, and since the valve mechanisms and the control mechanism therefor are provided, the structure is complicated and this can result in a size increase. Thus, this structure is undesirable in point of space saving.

The present invention is made to solve the above-mentioned problem, and an object thereof is to provide an inkjet printer in which the same ink is jetted from a plurality of independent nozzle arrays and the suction restoration operation is independently performed on the nozzle arrays, the inkjet printer having a simple structure, enabling space saving, and being capable of performing the suction restoration operation with little waste of ink.

In an inkjet printer according to a first aspect including: a recording head having a plurality of nozzle arrays that jet a plurality of inks; an ink cartridge storing a plurality of inks; a buffer tank extending vertically, and having a plurality of ink outlets that supply the inks from the ink cartridge to the nozzle arrays; and a suction portion sucking the inks in the plurality of nozzle arrays, of the plurality of nozzle arrays, nozzle arrays jetting a specific ink include a first nozzle array and a second nozzle array that are independent of each other, of the ink outlets of the buffer tank, a first ink outlet and a second ink outlet supplying the ink to the first and second nozzle arrays, respectively, are also independently disposed, upper parts of the first and second ink outlets communicate with each other through a communication portion in the buffer tank, the suction portion separately performs suction from the first and second nozzle arrays, and check valves allowing ink supply from the first and second ink outlets to the first and second nozzle arrays and inhibiting an ink flow in an opposite direction are provided in the first and second ink outlets, respectively.

In such an inkjet printer, since it is possible that after only one of the first and second nozzle arrays is restored, only the other nozzle array is restored without suction being simultaneously performed from the two nozzle arrays in the suction restoration operation, waste of discharged ink can be suppressed. In addition, since the upper part of the first ink outlet and the upper part of the second ink outlet corresponding to the first nozzle array and the second nozzle array, respectively, communicate with each other through the communication portion in the buffer tank, the flow path structure is simple. Further, since the check valves are provided in the first and second ink outlets, the intended effect can be realized with a space-saving and simple structure without the use of a complicated structure.

In an inkjet printer according to a second aspect, the ink outlets are arranged substantially in a line in a direction perpendicular to a direction in which the nozzle arrays are arranged, the ink outlet for a second ink is disposed between the first and second ink outlets for the specific ink, and the communication portion is provided so as to bypass the ink outlet for the second ink.

In such an inkjet printer, since the communication portion is provided so as to bypass the ink supply path for the second ink, the same specific ink is smoothly directed to each ink supply path through the communication path.

In an inkjet printer according to a third aspect, the suction portion has: a cap provided so as to cover the recording head and in which a protruding partition is provided on its bottom surface so that suction is separately performed from the first and second nozzle arrays; and a pump mechanism for sucking ink in the nozzle arrays.

In such an inkjet printer, suction can be separately performed on the first and second nozzle arrays with ease and accuracy.

The above and further objects and features of the invention will more fully be apparent from the following detailed description with accompanying drawings.

DETAILED DESCRIPTION OF THE EXEMPLARY EMBODIMENTS

Hereinafter, a detailed description will be given based on the drawings showing an embodiment. It is to be noted that the embodiment shown below is merely an example and may be modified as appropriate without departing from the gist of the present invention.

Figure 1:
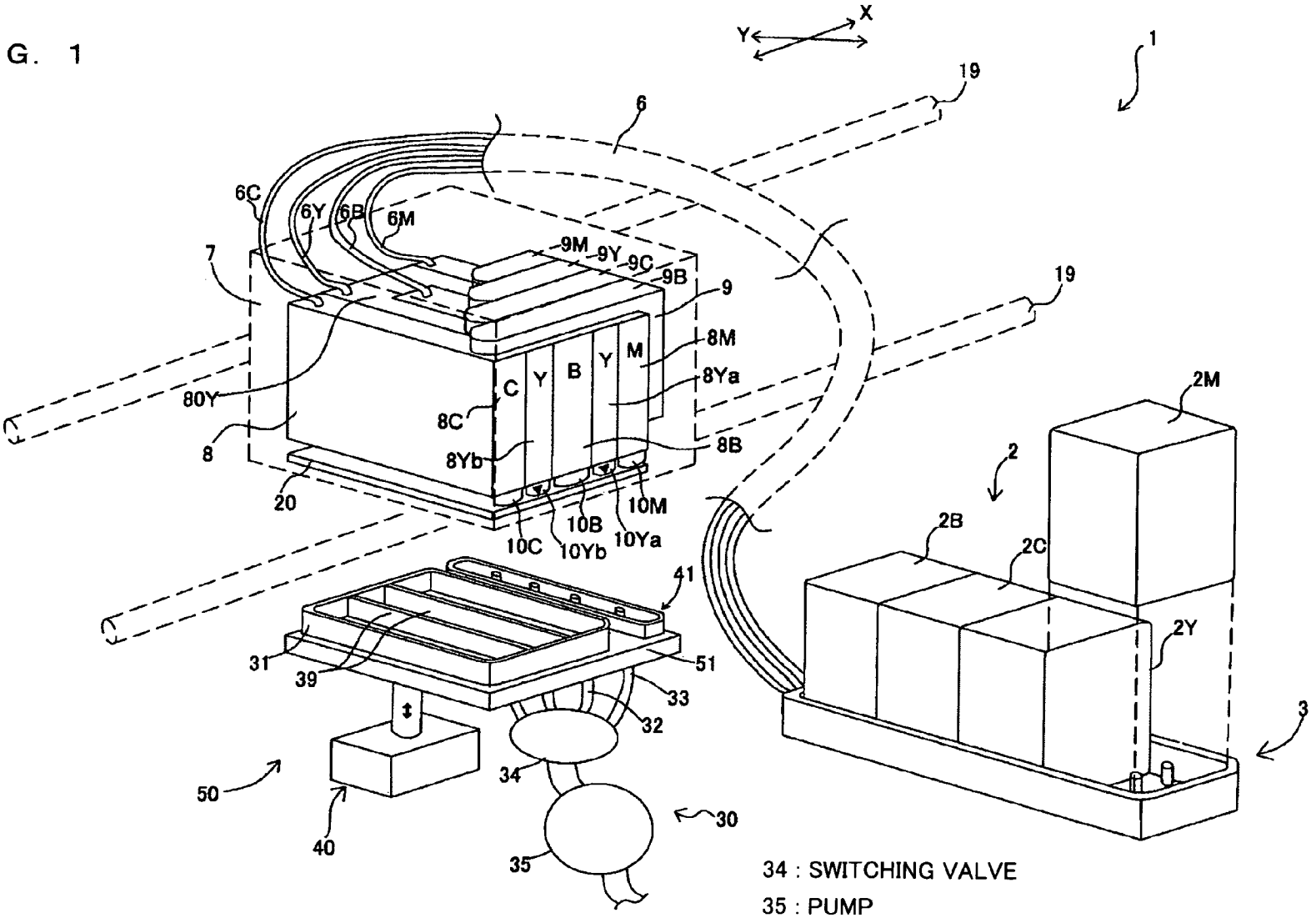
FIG. 1 is a schematic view of an inkjet printer.

In the following description, the ink jetting side is the lower surface and the downward direction, the side opposite thereto is the upper surface and the upward direction, and the scanning direction (X direction) of a carriage 7 of FIG. 1 is the horizontal direction. To indicate that a part is associated with the ink of a color, the reference numeral of the part is followed by B in the case of black, by C in the case of cyan, by Y in the case of yellow, or by M in the case of magenta, and to generally denote parts associated with the inks of the colors, the parts are denoted by a reference numeral not followed by B, C, Y, or M.

In an inkjet printer 1, inks are supplied from hollow box-shaped ink cartridges 2 as ink suppliers attached to an attachment portion 3 to a recording head 20 having a plurality of nozzles 11 through buffer tanks 8 mounted on a substantially box-shaped head holder formed of resin and functioning as the carriage 7. The carriage 7 is slidably attached to two juxtaposed guide shafts 19. The carriage 7 moves in the scanning direction (horizontal direction: X direction) and inks are jetted from the plurality of nozzles 11 to thereby perform printing on the recording medium.

The ink cartridges 2 store the inks of colors such as black B, cyan C, yellow Y and magenta M, and 2B, 2C, 2Y and 2M denote the ink cartridges for black, cyan, yellow and magenta, respectively. The ink cartridges 2 are connected to one ends of ink supply tubs 6 (6B, 6C, 6Y, 6M) as ink flow paths for the ink colors, respectively, and the inks are supplied and stored into the buffer tanks 8 (8B, 8C, 8Ya, 8Yb, 8M), respectively. The buffer tanks 8 will be described later in detail.

To restore ink jetting from a defective condition, a maintenance portion 50 that performs a suction purge of sucking ink in the nozzles 11 is disposed in one end in the horizontal direction of the inkjet printer 1 and below the guide shafts 19. When ink in the nozzles 11 is sucked, the carriage 7 is moved to the position where the maintenance portion 50 is disposed as shown in FIG. 1. The maintenance portion 50 will be described later in detail. Although not shown, a known wiper member for wiping a nozzle surface 18*a* of the recording head 20 to clean it is disposed beside the maintenance portion 50. In the other end of the inkjet printer 1, a non-illustrated flushing reception member is disposed. The flushing reception member periodically or forcibly causes ink to be jetted from the nozzles 11 of the recording head 20 to restore ink jetting from a defective condition.

To the bottom of the carriage 7, the recording head 20 is fixed, and the lowermost surface (nozzle surface 18*a*) of the carriage 7 where the nozzles 11 are opened is exposed downward. A plurality of buffer tanks 8 being integrated are disposed above the recording head 20. Ink outlets 10 provided in the buffer tanks 8 communicate with ink supply ports 12 of the recording head 20, and the inks in the buffer tanks 8 are supplied to the nozzles 11 through the ink outlets 10 and the ink supply ports 12.

The recording head 20 will be described in detail by using FIGS. 2 and 3. In the recording head 20, as in the recording head of the second embodiment described in U.S. Patent Application Publication No. US2006/0028519, a cavity unit 25 supplied with ink from the buffer tanks 8 and a plate-form piezoelectric actuator unit 26 having a plurality of piezoelectric deformation portions are bonded together, and on the upper surface thereof, two flexible wiring members 27*a* and 27*b* have one ends electrically connected to the actuator unit 26 and have the other ends drawn out parallel to the surface thereof in the opposite directions in the X direction. Driving circuits 33*a* and 33*b* are mounted on the flexible wiring members 27*a* and 27*b*, respectively. The driving circuits 33*a* and 33*b* transmit printing data to the actuator unit 26, and selectively drive the actuator unit 26.

Figure 2:
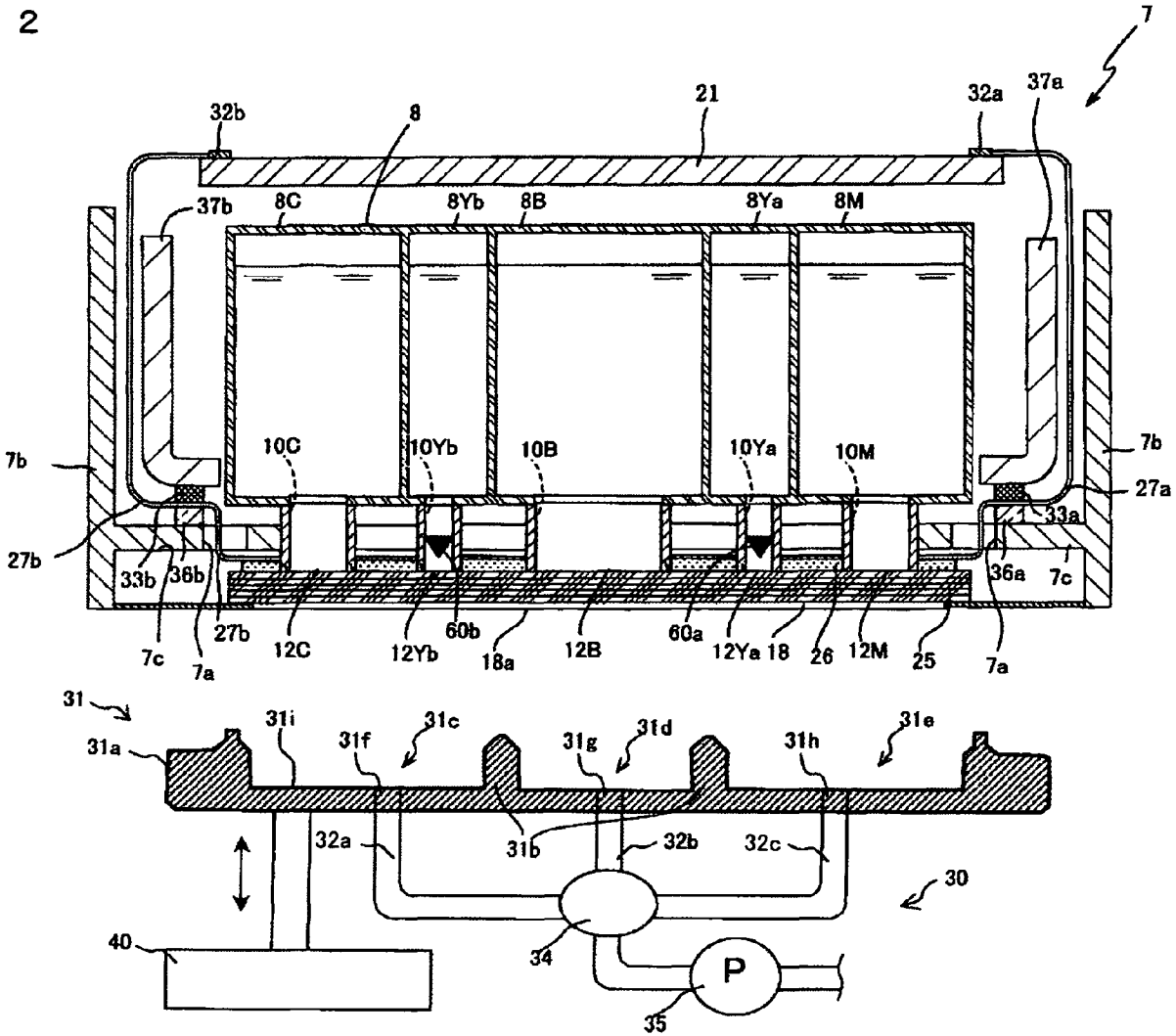
FIG. 2 is a schematic view showing the relation between the positions of buffer tanks and a suction portion.

The flexible wiring members 27*a* and 27*b* being drawn out pass through slits 7*a* penetrating a bottom wall 7*c* of the carriage 7 as shown in FIG. 2, passes between the driving circuits 33*a* and 33*b* and rubbery elastic members 36*a* and 36*b* fixed to the bottom wall 7*c*, and extend upward along side walls 7*c* of the carriage 7 to be electrically connected to connectors 32*a* and 32*b* of a junction circuit board 21. The driving circuits 33*a* and 33*b* are pressed by the rubbery elastic members 36*a* and 36*b* to be in contact with radiator plates 37*a* and 37*b* so that heat can conduct therebetween.

Figure 3:
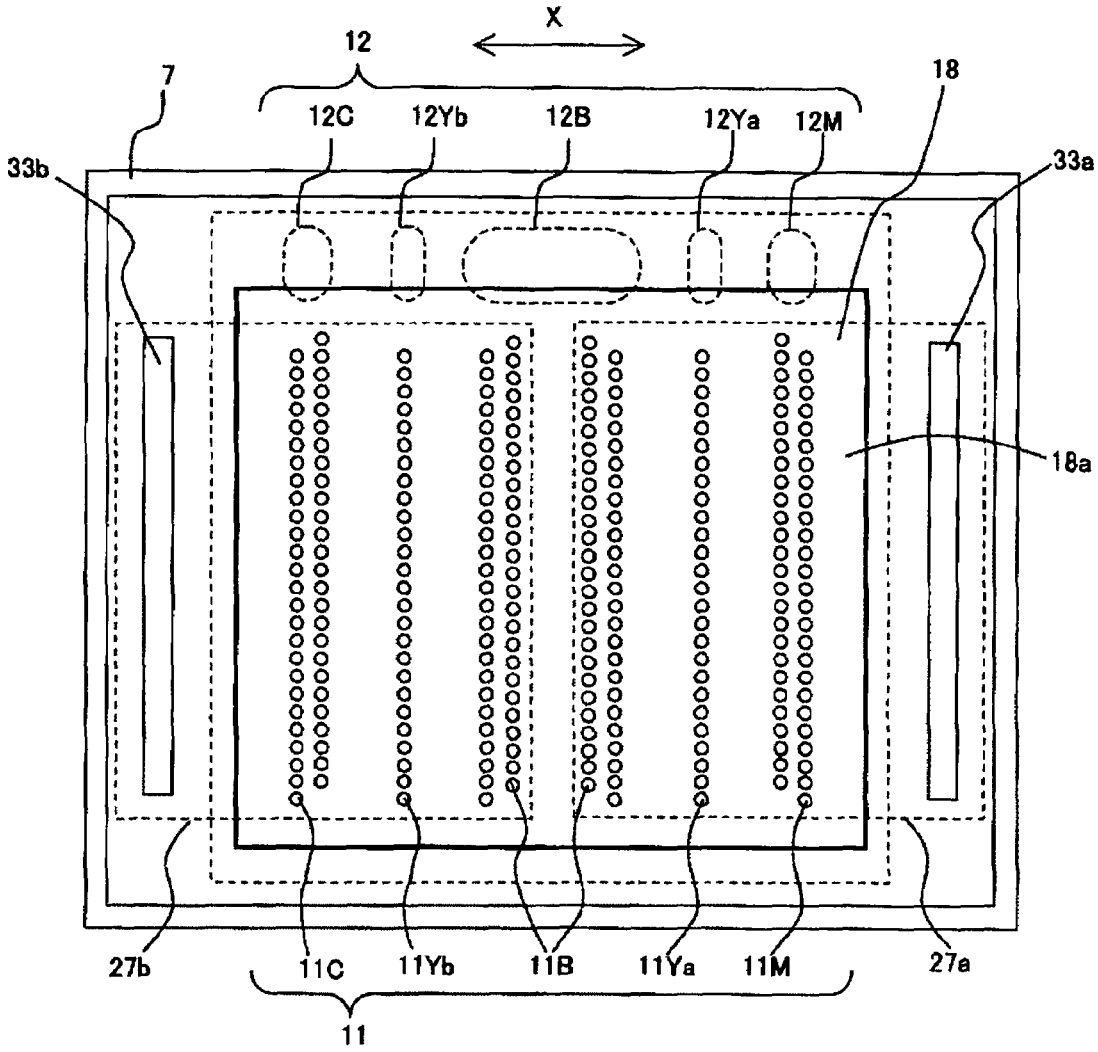
FIG. 3 is a bottom view of a recording head.

As shown in FIG. 3, on a nozzle plate 18 disposed on the lowermost surface of the cavity unit 25, a plurality of nozzles 11 for jetting the inks are provided in such a manner that the nozzles for each ink color form nozzle arrays in a direction (Y direction) perpendicular to the scanning direction (X direction) of the carriage 7 (hereinafter, the arrays are denoted by 11B, 11Ya, 11Yb, 11C and 11M). Four nozzle arrays 11B for black ink are disposed in the center of the nozzle plate 18, and two nozzle arrays 11M for magenta ink and two nozzle arrays 11C for cyan ink which are each juxtaposed are disposed on both sides of the nozzle plate 18. One nozzle array 11Ya and one nozzle array 11Yb for yellow ink are disposed apart from each other beside the nozzle arrays 11B for black ink so as to sandwich the nozzle arrays 11B. Only the number of nozzle arrays 11B for black ink is four because black ink is highly frequently used. While a plurality of nozzle arrays are disposed on one recording head 20 in the present embodiment, two recording heads may be juxtaposed.

In the cavity unit 25, the ink supply ports 12 (12B, 12Ya, 12Yb, 12C, 12M) supplying the inks of the colors from the ink outlets 10 of the buffer tanks 8 to the nozzles 11 are provided for each ink color so as to be lined up in the X direction. As well known, the ink supply ports 12 communicate with pressure chambers (not shown) corresponding to the nozzles through a common ink chamber (not shown) extending parallel to the nozzle arrays. In the embodiment, the black ink supply port 12B is larger in the lateral direction (X direction) than the ink supply ports for the other colors because it supplies ink to the four nozzle arrays 11B for black ink. The yellow ink supply ports 12Ya and 12Yb are disposed apart from each other so as to sandwich the black ink supply port 12B. The yellow ink supply ports 12Ya and 12Yb supply yellow ink to the nozzle arrays 11Ya and 11Yb, respectively.

Then, by selectively deforming the parts of the actuator unit 26 corresponding to the pressure chambers, ink is jetted from the corresponding nozzles.

The actuator unit 26 has a structure in which a plurality of ceramic layers covering a plurality of pressure chambers, respectively, and electrodes are alternately laminated so as to be integrated and are fired like the known actuator described in Japanese Patent Application Laid-Open No. 2005-322850. By selectively applying a voltage between the two electrodes sandwiching the ceramic layers, the ink in the pressure chambers are pressurized. Connection terminals between which and the electrodes electricity passes are formed on the uppermost surface of the actuator unit 26, and the two flexible wiring members 27*a* and 27*b* are connected to the connection terminals. One flexible wiring member 27*a* is connected to the connection terminals of the actuator corresponding to the nozzle array 11B, the nozzle array 11Ya and the nozzle array 11M, and the other flexible wiring member 27*b* is electrically connected to the connection terminals of the actuator corresponding to the nozzle array 11B, the nozzle array 11C and the nozzle array 11Yb.

Next, the buffer tanks 8 will be described. The buffer tanks 8 have a structure in which the tanks 8B, 8Ya, 8Yb, 8C and 8M independently provided for each ink color are adjacently arranged in the X direction so as to be integrated. The buffer tanks 8 are elongated in the Y direction as shown in FIG. 1. Rear parts of the buffer tanks 8 are connected to one ends of ink supply tubes 6B to 6M, respectively, and the inks supplied from the ink cartridges 2B to 2M are stored in the buffer tanks 8B to 8M, respectively. On the lower surfaces of front parts of the tanks 8, ink outlets 10B, 10Ya, 10Yb, 10C and 10M communicating with the ink supply ports 12 are formed so as to tubularly hand down. The black buffer tank 8B is disposed in the center, and the yellow buffer tanks 8Ya and 8Yb are disposed apart from each other with a distance between so as to sandwich the black buffer tank 8B in correspondence with the yellow ink supply ports 12Ya and 12Yb.

In the buffer tanks 8, an ink communication portion 80Y is provided that makes the yellow buffer tanks 8Ya and 8Yb communicate with each other in rear parts of the yellow buffer tanks 8Ya and 8Yb (that is, the ends on the side away from the yellow ink supply ports 12Ya and 12Yb). The ink communication portion 80Y is provided so as to bypass the black buffer tank 8B. That is, as is apparent from FIG. 1, the yellow buffer tanks 8Ya and 8Yb and the ink communication portion 80Y are provided in a U-shape when viewed as a plan view, and upper parts of the yellow ink outlets 10Ya and 10Yb communicate with each other through the yellow buffer tanks 8Ya and 8Yb and the ink communication portion 80Y. One end of the yellow ink supply tube 6Y connected to the yellow ink cartridge 2Y is connected to the ink communication portion 80Y so that yellow ink is supplied to the yellow buffer tanks 8Ya and 8Yb.

As a consequence of the above, the yellow ink outlets 10Ya and 10Yb are disposed apart from each other so as to sandwich the black ink outlet 10B, and check valves 60*a* and 60*b* are provided in the yellow ink outlets 10Ya and 10Yb, respectively. In the check valves 60*a* and 60*b*, as well known, valve members are pushed in a direction that closes the openings formed in the yellow ink outlets 10Ya and 10Yb, and although the supply of yellow ink from the yellow buffer tanks 8Ya and 8Yb to the yellow ink supply ports 12Ya and 12Yb are allowed against the pushing force, the ink flow in the opposite direction is inhibited.

The buffer tanks 8B to 8M have exhaust portions 9B to 9M extending downward from the upper surfaces along the side surfaces thereof, respectively. The exhaust portions 9B to 9M have an exhaust vale (not shown) in each of exhaust paths (not shown) communicating with the buffer tanks 8B to 8M, respectively, and when ink flows through the buffer tanks, the air contained in the ink is surfaced and stored, and the stored air can be discharged to the outside from the exhaust portions 9B to 9M by an exhaust cap 41 and a suction portion 30 described later.

Figure 4:
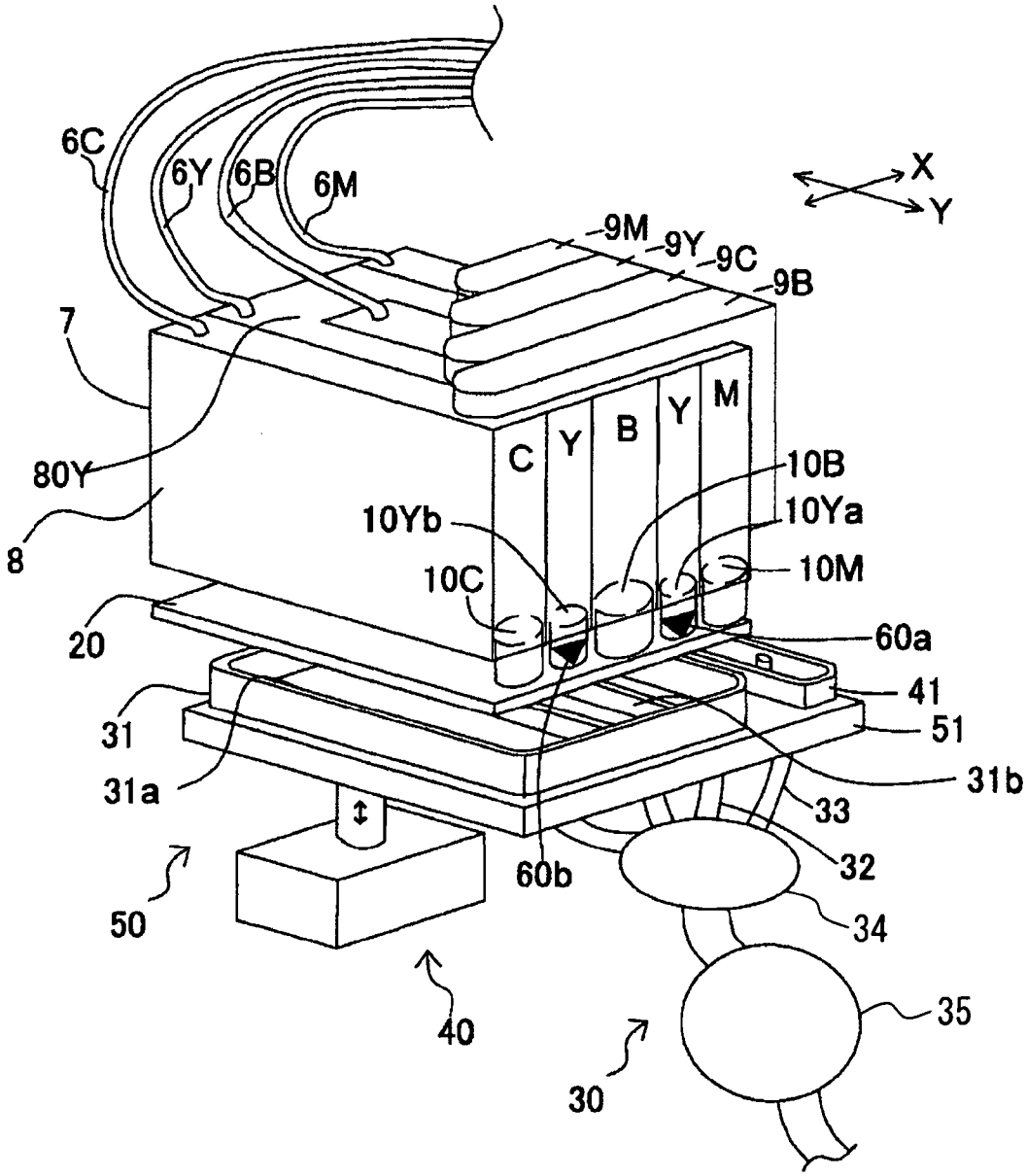
FIG. 4 is an enlarged view of the buffer tanks and the suction portion.

Next, the maintenance portion 50 will be described by using FIGS. 2 to 4. The maintenance portion 50 has a maintenance main body 51, a substantially rectangular suction cap 31 being elastic and covering the nozzle surface 18*a* of the recording head 20, the substantially rectangular exhaust cap 41 being elastic and covering the lower ends of the exhaust portions 9 of the buffer tanks 8, and the suction portion 30 performing suction. The maintenance main body 51 is selectively elevated and lowered by an elevating and lowering mechanism 40 so that the suction cap 31 and the exhaust cap 41 can be brought into intimate contact with and separated from the nozzle surface 18*a* of the recording head 20 and the openings at the lower ends of the exhaust portions 9, respectively.

The suction portion 30 has: a switching valve 34 communicating with outlets 31*f* to 31*h* provided at the bottom of the suction cap 31 and outlets (not shown) provided at the bottom of the exhaust cap 41 through suction tubes 32 and 33; and a suction pump 35 communicating with the downstream side of the switching valve 34. The switching valve 34 selectively allows the suction cap 31 and the exhaust cap 41 to communicate with the suction pump 35. The switching valve 34 communicates with the outlets 31*f* to 31*h* so that it can selectively cause a negative pressure in chambers 31*c* to 31*e* provided in the suction cap 31 described later. The waste ink discharged from the suction pump 35 is stored in a known waste ink reservoir (not shown).

The suction cap 31 has an annular seal lip 31*a* provided in a protruding condition along the periphery so as to cover the entire nozzle surface 18*a*. In the seal lip 31*a*, two partitions 31*b* that partition the suction cap 31 in the X direction in correspondence with the nozzle arrays and partition it by elongating in the direction of the length (Y direction) are provided in a protruding condition, thereby forming the chambers 31*c* to 31*e*. On the inner surface of the suction cap 31, the chamber 31*d* inside the two partitions 31*b* corresponds to the four nozzle arrays 11B that jet black ink, and the chambers 31*c* and 31*e* situated on both sides of the chamber 31*d* and constituted by the inside surface of the seal lip 31*a* and the outside surfaces of the partitions 31*b* correspond to the nozzle arrays for cyan ink (11C) and one nozzle array for yellow ink (11Yb), and the nozzle arrays for magenta ink (11M) and the other nozzle array for yellow ink (11Ya) disposed on both sides of the nozzle arrays 11B, respectively. The outlets 31*f* to 31*h* to which one end of the suction tubes 32*a* to 32*c* having the other end connected to the switching valve 34 are connected are provided on the bottom surfaces of the chambers 31*c* to 31*e*, respectively. With this structure, since a negative pressure can be independently caused in the chambers 31*c* to 31*e*, suction can be independently or simultaneously performed on the nozzle arrays.

When the ink suction purge is performed on the nozzles 11 of the nozzle surface 18*a*, the carriage 7 moves to a position opposite to the suction cap 31, and the elevating and lowering mechanism 40 selectively elevates and lowers the maintenance main body 51 to thereby bring the suction cap 31 into intimate contact with the nozzle surface 18*a* of the recording head 20. The switching valve 34 is switched to a position that allows the suction cap 31 and the suction pump 35 to communicate with each other, and causes them to communicate with the outlets 31*f* to 31*h* of the chambers 31*c* and 31*e* corresponding to the nozzles 11 from which suction is to be performed, thereby causing a negative pressure in the suction cap 31 by the suction pump 35.

In the present embodiment, although the suction purge can be simultaneously performed on all the chambers 31*c* to 31*e*, the suction operation is performed so that suction is separately performed from the nozzle arrays 11Ya and 11Yb for yellow ink. That is, when suction is performed from the nozzle arrays 11Ya and 11Yb for yellow ink, first, the suction purge is performed on the nozzle arrays 11M for magenta ink and the nozzle array 11Ya for yellow ink. The nozzle surface 18*a* is covered with the suction cap 31, the switching valve 34 is switched to a condition where the suction tube 32*c* and the outlet 31*h* communicate with each other, and the suction pump 35 is driven to cause a negative pressure in the chamber 31*e*.

Consequently, magenta ink is sucked from the magenta buffer tank 8M through the nozzles in the nozzle arrays 11M, and at the same time, the check valve 60*a* of the yellow ink outlet 10Ya is opened so that ink is discharged from the yellow buffer tank 8Ya through the nozzles of the nozzle array 11Ya. At this time, since the yellow buffer tank 8Ya communicates with the yellow buffer tank 8Yb through the communication portion 80Y as shown in FIG. 4, there is a possibility that an ink flow such that the yellow ink in the yellow buffer tank 8Yb is discharged to the yellow ink outlet 10Ya by the negative pressure occurs in the yellow buffer tank 8Ya, the communication portion 80Y and the yellow buffer tank 8Yb and ink is sucked also from the nozzles in the nozzle array 11Yb in the opposite direction to allow ingress of outside air. However, since the check valve 60*b* is provided in the yellow ink outlet 10Yb, the ink flow from the nozzles in the nozzle array 11Yb to the yellow buffer tank 8Yb is prevented, whereby the ingress of outside air can be prevented.

Then, the suction purge is performed on the nozzle arrays 11C for cyan ink and the nozzle array 11Yb for yellow ink 11Yb in a similar manner. Although the check valve 60*b* is opened also in this case, since the other check valve 60*a* is closed, the ink flow in the opposite direction can be prevented. When the nozzles 11 are preserved, the switching valve 34 or the suction pump 35 is stopped at a position that inhibits the outlets 31*f* to 31*h* of the suction cap 31 from communicating with the outside so that the space in the suction cap 31 is enclosed when the suction cap 31 abuts the nozzle surface 18*a*.

In the present embodiment, yellow ink is jetted from the nozzle arrays 11Ya and 11Yb independently formed so as to be disposed apart from each other, and in correspondence therewith, the yellow buffer tanks 8Ya and 8Yb are separately formed. However, the ink color for which this structure is adopted is not specifically limited to yellow, and the structure may be adopted for any other of the ink colors as long as the buffer tanks are structured so that ink is supplied from the same ink supplier to the nozzle arrays disposed apart from each other and the check valves are provided in the ink outlets supplying ink to the nozzle arrays so that the suction restoration operation is separately performed on the nozzle arrays.

While in the present embodiment, the nozzle arrays 11Ya and 11Yb for yellow ink to which ink is separately supplied from the same buffer tank communicate with each other through the communication portion 80Y so as to bypass the black buffer tank 8B disposed in the center of the buffer tanks 8, the present invention is not limited to this structure, and a structure may be adopted in which the arrangement of the buffer tanks 8 and the communication portion are associated in accordance with the arrangement of the nozzle arrays.

Figure 5A:
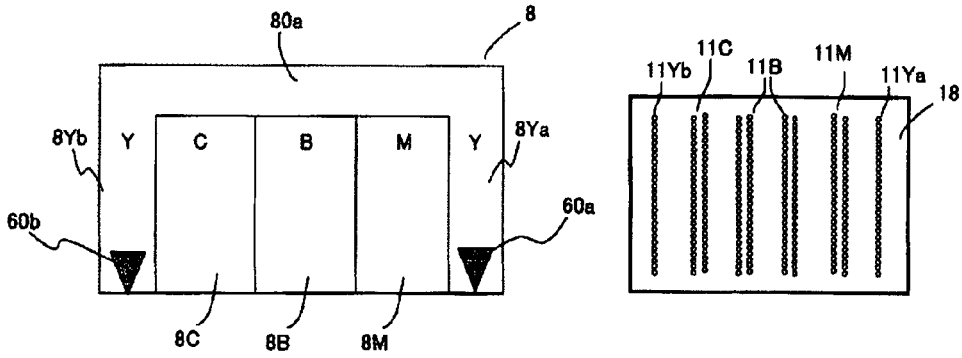
FIGS. 5A to 5C are views showing other examples of the buffer tank structure.
Figure 5B:
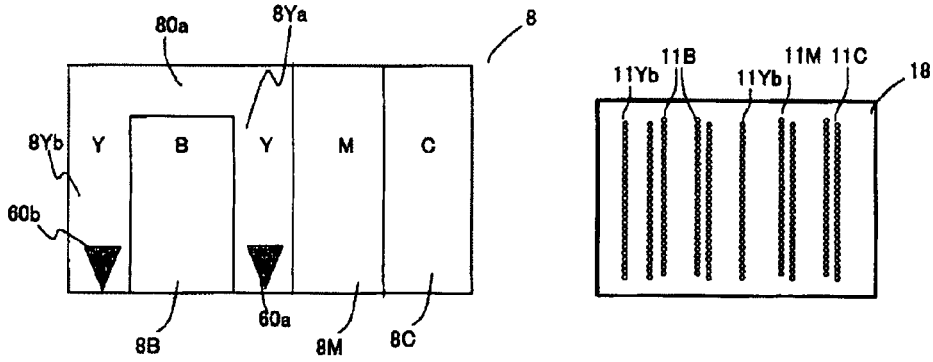
Figure 5C:
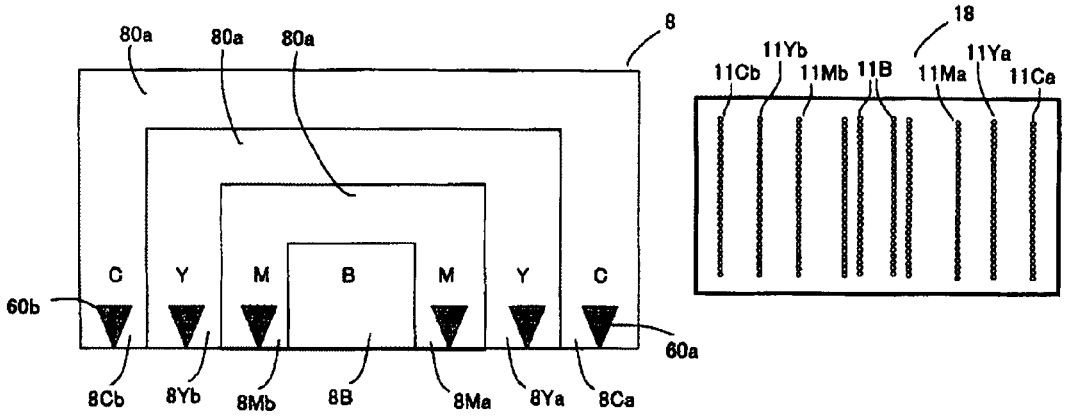

For example, the buffer tanks 8 shown in FIG. 5A are an example in which the nozzle arrays 11Ya and 11Yb for yellow ink disposed apart from each other are disposed on both sides of the nozzle plate 18, and a communication portion 80*a* is formed so as to bypass the black buffer tank 8B in the center, the cyan buffer tank 8C and the magenta buffer tank 8M. FIG. 5B shows a modification thereof in which in the embodiment described first, the cyan buffer tank 8C and the magenta buffer tank 8M are adjacently disposed. FIG. 5C shows an example in which in the structure described in Patent Document 1, the nozzle arrays for the color inks other than the black ink are formed apart from each other.

In the other embodiments as described above, check valves are provided in the ink outlets of the buffer tanks formed separately from the communication portion in correspondence with the nozzle arrays disposed apart from each other, and the partitions 31*b* of the suction cap 31 are formed so that the suction restoration operation is separately performed on the nozzle arrays disposed apart from each other when the suction restoration operation is performed on the nozzle arrays.

As described above, when the suction purge is performed on the nozzle arrays for a specific ink independently provided apart from each other, the check valves are provided in the ink outlets in the buffer tanks in which the ink is stored, and suction is separately performed from the nozzle arrays, so that space can be saved, the structure can be simplified, and waste of ink can be reduced.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An inkjet printer, comprising:

a recording head having a plurality of nozzle arrays that jet a plurality of inks;

an ink cartridge storing a plurality of inks;

a buffer tank extending vertically, and having a plurality of ink outlets that supply the inks from the ink cartridge to the nozzle arrays; and a suction portion sucking the inks in the plurality of nozzle arrays, wherein of the plurality of nozzle arrays, nozzle arrays jetting a specific ink comprise a first nozzle array and a second nozzle array that are independent of each other, of the ink outlets of the buffer tank, a first ink outlet and a second ink outlet supplying the ink to the first and second nozzle arrays, respectively, are also independently disposed, upper parts of the first and second ink outlets communicate with each other through a communication portion in the buffer tank, the suction portion separately performs suction from the first and second nozzle arrays, and check valves allowing ink supply from the first and second ink outlets to the first and second nozzle arrays and inhibiting an ink flow in an opposite direction are provided in the first and second ink outlets, respectively.

2. The inkjet printer according to claim 1, wherein the ink outlets are arranged substantially in a line in a direction perpendicular to a direction in which the nozzle arrays are arranged, the ink outlet for a second ink is disposed between the first and second ink outlets for the specific ink, and the communication portion is provided so as to bypass the ink outlet for the second ink.

3. The inkjet printer according to claim 1, wherein the suction portion has: a cap provided so as to cover the recording head and in which a protruding partition is provided on its bottom surface so that suction is separately performed from the first and second nozzle arrays; and a pump mechanism for sucking ink in the nozzle arrays.

4. The inkjet printer according to claim 2, wherein the suction portion has: a cap provided so as to cover the recording head and in which a protruding partition is provided on its bottom surface so that suction is separately performed from the first and second nozzle arrays; and a pump mechanism for sucking the ink in the nozzle arrays.

* * * * *